US005689613A

United States Patent [19]

Cherry

[11] Patent Number: 5,689,613

[45] Date of Patent: Nov. 18, 1997

[54] PLATINUM PLATED QUARTZ TUBES AND METHOD OF MAKING THE SAME

[75] Inventor: Thomas A. Cherry, Greensburg, Ind.

[73] Assignee: DriQuik, Inc., Greensburg, Ind.

[21] Appl. No.: 622,118

[22] Filed: Mar. 26, 1996

Related U.S. Application Data

[63] Continuation-in-part of Ser. No. 366,034, Dec. 29, 1994, abandoned.

[51] Int. Cl.[6] ..... A45D 20/40

[52] U.S. Cl. ..... 392/407; 392/422; 313/113; 219/553

[58] Field of Search ..... 392/407, 422; 219/553; 313/113, 578, 579; 29/611; 427/106, 110, 125, 383.5; 362/296

[56] References Cited

U.S. PATENT DOCUMENTS

| | | | |
|---|---|---|---|
| 2,135,732 | 11/1938 | Randall et al. | 313/113 |
| 3,338,737 | 8/1967 | Boyce | 427/106 |
| 3,767,956 | 10/1973 | Bauer | 313/113 |
| 3,983,513 | 9/1976 | DeCaro | 313/113 |
| 4,281,267 | 7/1981 | Johnson | 313/113 |
| 4,287,231 | 9/1981 | DeCaro et al. | 427/106 |
| 5,168,193 | 12/1992 | Hoegler | 313/113 |
| 5,276,763 | 1/1994 | Gobel et al. | 392/422 |
| 5,398,425 | 3/1995 | Cherry et al. | 34/270 |

FOREIGN PATENT DOCUMENTS

| | | | |
|---|---|---|---|
| 838796 | 5/1952 | Germany | 313/113 |
| 3-95501 | 4/1991 | Japan . | |

*Primary Examiner*—Tu B. Hoang

*Attorney, Agent, or Firm*—Barnes, Kisselle, Raisch, Choate, Whittemore & Hulbert

[57] ABSTRACT

The quartz tubes of the heating elements of an infrared oven have a limited portion of their circumference coated with a mixture containing platinum. The platinum coating provides a reflective surface to direct infrared radiation towards the object to be heated within the oven. The heating element tubes coated with platinum provide substantially the same performance and are significantly less expensive to manufacture than conventional heating element tubes with a gold reflective coating.

13 Claims, 2 Drawing Sheets

PLATINUM PLATED QUARTZ TUBES AND METHOD OF MAKING THE SAME

REFERENCE TO A COPENDING APPLICATION

This application is a continuation-in-part of U.S. patent application, Ser. No. 08/366,034, filed Dec. 29, 1994 now abandoned.

FIELD OF THE INVENTION

This invention relates to drying ovens and more particularly to electric heating elements for infrared drying ovens.

BACKGROUND OF THE INVENTION

It is well-known to dry freshly painted objects including freshly painted motor vehicle bodies in a drying oven having electric heating elements with tubes transparent to infrared radiation. One such oven is shown in U.S. Pat. No. 5,398,425. To promote and enhance the drying process reflective surfaces are employed throughout the interior of the oven to reflect and direct heat toward the object to be dried. Preferably a reflective coating of gold, which has good reflecting characteristics, is applied to at least a portion of each infrared tube. However, the gold coating material is expensive and current methods to apply the gold to the tube provide a relatively thick coating of the gold. Thus, heating elements with gold coated tubes are expensive to manufacture.

SUMMARY OF THE INVENTION

According to the present invention, a portion of the tube of an electric heating element for an infrared drying oven is coated with a relatively thin layer of a mixture containing platinum to reflect infrared radiation towards the object to be dried within the oven. Preferably, to provide this relatively thin coating, the platinum is applied by spraying the mixture containing platinum onto the tube. This uses less platinum per tube and thus lowers the cost to manufacture the tube. Further, the platinum mixture is less expensive than the mixtures containing gold which are used for this application. Thus, the cost savings are furthered because the method used applies less material to the tube and the coating mixture itself is less expensive than previously used materials. Still further, even with the thinner layer of platinum the heating elements of this invention provide substantially the same performance as the conventional gold coated tubes previously used.

Objects, features and advantages of this invention include providing an infrared heating element with a reflective coating containing platinum which is less expensive than conventional applications using a gold coating, is considerably less expensive to manufacture than prior heating elements, is capable of being applied with a spray applicator, requires less material to coat the tube, provides substantially the same reflective capabilities as prior gold coated tubes, is relative easy to apply, is rugged, durable, easy to clean, and has a long, useful life in service.

BRIEF DESCRIPTION OF THE DRAWINGS

These and other objects, features, and advantages of this invention will be apparent from the following detailed description of the preferred embodiments and best mode, appended claims, and accompanying drawings in which:

DETAILED DESCRIPTION

Figure 1:
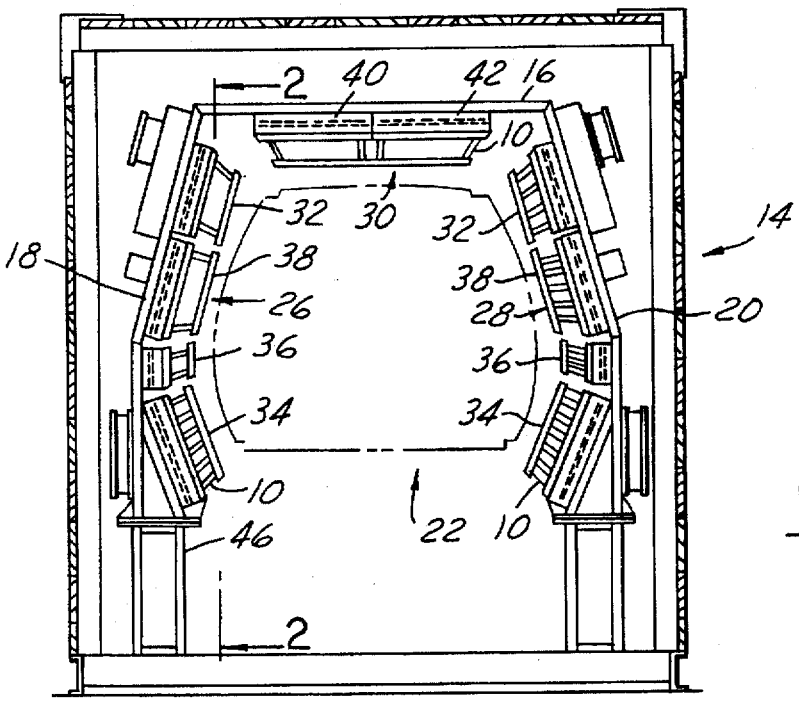
FIG. 1 is a perspective view of a typical oven with quartz tube heating elements embodying this invention.

Referring in more detail to the drawings, FIG. 1 shows a plurality of infrared heating elements 10 embodying this invention with a portion of the circumference of their tubes covered with a reflective platinum based coating, disposed in a drying oven 14. The oven 14 has a top wall 16 and side walls 18, 20 defining an enclosure 22 which is open at one end to admit a freshly painted object, such as a vehicle body 24, to be dried. To promote drying of all of the painted surfaces of the vehicle body 24, three banks 26, 28, 30 of heating elements 10 are provided, one adjacent each side wall 18, 20 of the oven and one adjacent the top wall 16 of the oven.

While the number and placement of the heating elements 10 may vary, in this instance, each bank 26, 28 adjacent a side wall 18, 20 has an upper longitudinally extending unit 32 of heating elements 10, a lower longitudinally extending unit 34 of heating elements and two intermediate longitudinally extending units 38, 40 of heating elements. The bank 30 of heating elements adjacent the top wall 16 of the oven 14 has two horizontally disposed and longitudinally extending units 42, 44 of heating elements 10 disposed adjacent each other. All of the heating units in each bank are supported on a frame work 46.

Figure 2:
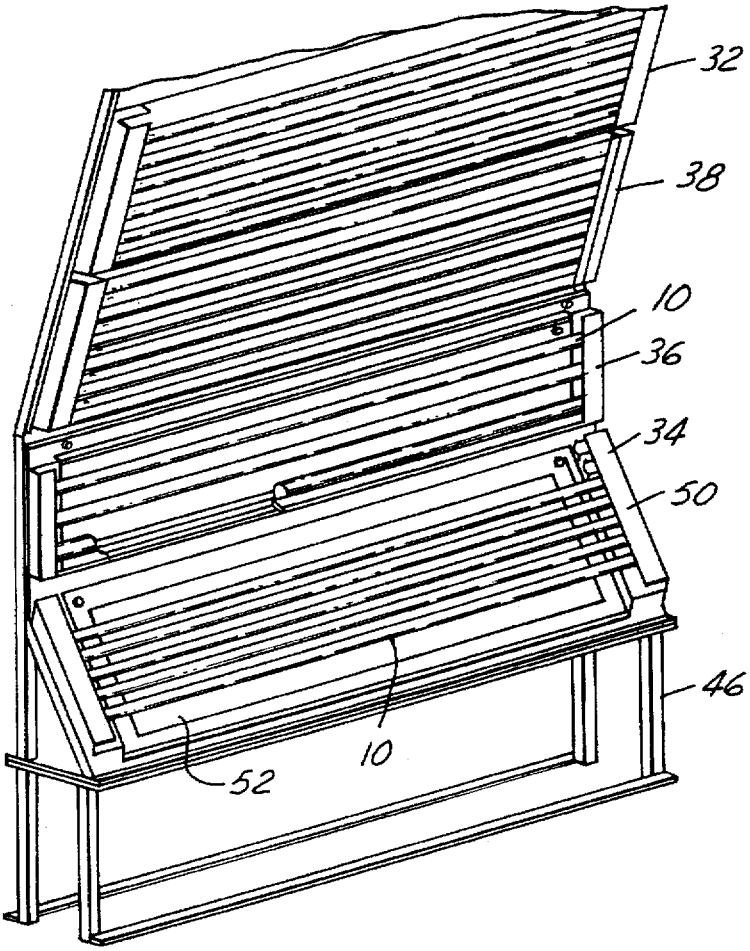
FIG. 2 is an enlarged and fragmentary perspective view of some of the banks of heating elements within the oven.

As shown in FIG. 2, each of the heating units comprises a frame 50 on which is mounted a plurality of heating elements 10 and a reflector plate 52. The size of the individual heating units and the number of heating elements 10 they carry may vary, but each is essentially of the same construction. The reflector plate 52 of each heating unit is rigidly secured to the frame work and has a polished heat reflecting surface facing inwardly and generally toward the object to be dried within the enclosure. The reflector plate may be made of polished steel or chrome plated and polished steel.

Figure 3:
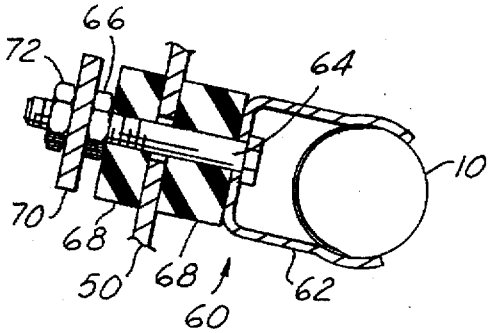
FIG. 3 is a cross-sectional view of a mount for a heating element.

The heating elements 10 are preferably elongated, parallel and spaced apart tubular assemblies carried by the frame 50 and extending generally longitudinally of the oven. As shown in FIG. 3, the ends of each heating element 10 are releaseably attached by a mount 60 on the frame 50. Each mount 60 of the frame 50 comprises a channel shape clip 62 of a flexible and resilient material. The side walls of each clip have confronting and concave or arcuately curved end portions which cooperate in gripping an end cap of a heating element 10. The mount 60 containing the clip 62 is attached to the frame 50 by a bolt 64. The bolt 64 extends through the base of the clip 62 and through a hole in the frame 50 and is secured to the frame 50 by a nut 66. Electrical insulators 68 received on the bolt are provided on opposite sides of the frame 50. All the heating elements 10 of each heating unit have their ends electrically connected to high temperature wires or bus bars 70. The high temperature wires or bus bars 70 are outside of the frame 50 and secured to the bolts 68 by nuts 72. Thus, the bolts 68 provide electric conductors carrying an electric current to the heating element 10.

Figure 4:
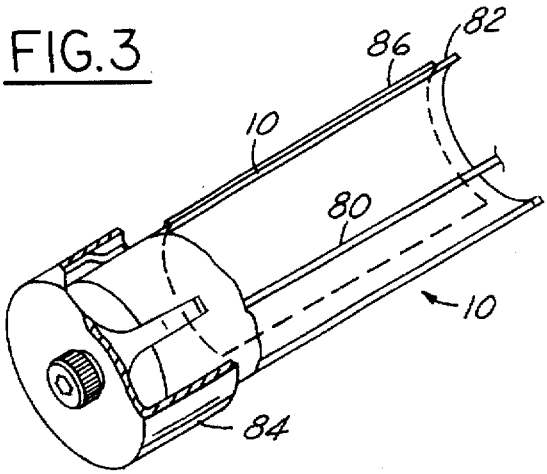
FIG. 4 is a broken view showing an end cap assembly on a tube of the heating element.

As shown in FIG. 4, each heating element 10 has an electric filament 80, preferably of a metal such as tungsten, mounted in a protective tube 82 of a material transparent to infrared radiation, such as quartz, by end cap assemblies 84. To electrically connect the filament 80 to the bus bars 70 each end cap assembly 84 is electrically conductive and releaseably received in one of the channel-shaped clips 62. To reflect infrared radiation towards the object to be heated that would otherwise be emitted through the tube 82 in directions generally away from the object to be heated, a reflective metallic coating 86 is applied to a portion of the circumference of each tube 82.

According to the present invention, the coating 86 contains finely divided particulate platinum adhered to the tube 82. A liquid mixture of platinum particles, a resin and a solvent vehicle is applied to the tube and dried and cured to produce the dry film coating 86 firmly adhered to the tube. The solvents provide a vehicle for application of the mixture to the tubes 82, and when cured, the resins permanently adhere the platinum to the tube. Preferably, the average size of the platinum particles in the mixture is in the range of about 34 to 38 microns and the weight percent of platinum to the resin is about 1 to 12. Preferably, to facilitate spraying of the mixture onto the tubes 82, it has a viscosity of approximately 52 to 57 second in a Zahn No. 2 cup. A presently preferred liquid mixture is sold under the name of Liquid Bright Platinum Solution by Englehard Corporation of 1 West Central Avenue, East Newark, N.J. 07029. This mixture is believed to be composed of particulate platinum, turpentine, alpha terpineol, naptha and gilsonite.

Figure 5:
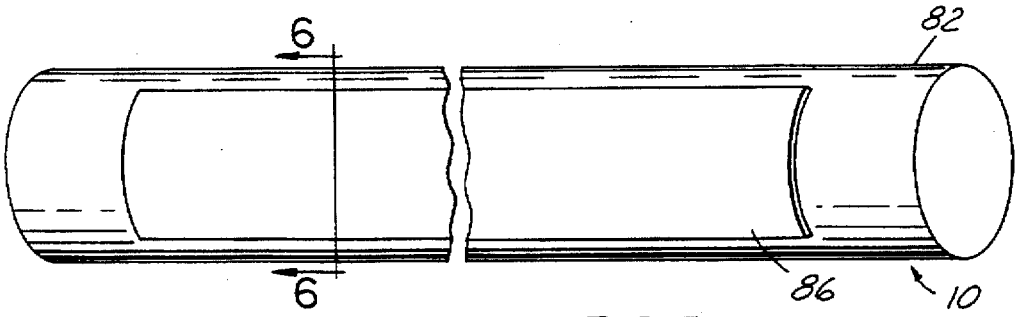
FIG. 5 is a rear side view of a tube illustrating the coating as applied to substantially the entire axial length of the tube.
Figure 6:
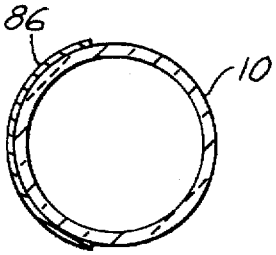
FIG. 6 is a cross-sectional view of a tube illustrating the coating as applied to a limited circumferential portion of the tube.

As shown in FIG. 5, the tubes 82 of the heating elements 10 have the platinum coating 86 applied to substantially the entire axial length of each tube. To electrically insulate or isolate the metallic coating 86 from the end caps 84, approximately one to one and one-half inches of the tube 82 at each end of the tube is not coated so that the coating terminates short of and is spaced from the end caps 84 when assembled on the tube. As shown in FIG. 6, to allow infrared radiation to pass through at least the portion of the tube 82 facing the object to be dried, the coating 86 on the tube is applied to a limited circumferential extent or portion of the tube. Desirably, the coating 86 does not cover more than about 60% of the circumference of the tube 82, is usually in the range of about 35% to 55% and preferably, the coating 86 is applied to about 45% of the circumference of each tube 82.

Figure 7:
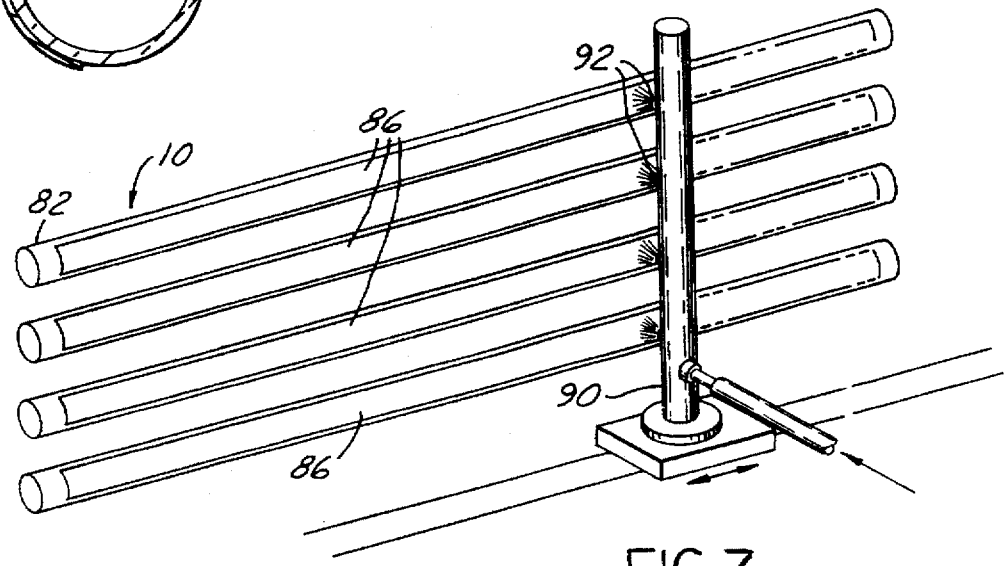
FIG. 7 is a perspective view of several tubes as they are being coated on a spray rack.

FIG. 7 shows several of the tubes 82 carried by a rack (not shown) while a liquid mixture containing finely divided platinum is being sprayed onto the tubes 82. The liquid mixture is applied at room temperature by an applicator 90 with nozzles 92 spraying the mixture onto the tubes 82 preferably at an air pressure of less than 100 psi, and more preferably, the mixture is sprayed onto the tubes 82 at an air pressure of about 40 psi. In this instance, several tubes 82 are sprayed simultaneously with an applicator 90 having a plurality of nozzles 92 each adjusted to a spray pattern that covers only the desired portion of one tube 82. Alternatively, the portion of the tubes 82 that is to remain uncoated can be masked or covered, such as by a template or an adhesive tape, before the coating 86 is applied. With the mixture applied to the tubes 82 in this manner, a relatively thin, substantially uniform and substantially solid coating 86 of the desired portion of the tube 82 can be achieved.

Preferably, after the liquid mixture has been sprayed onto the desired portion of the tubes 82, the tubes 82 are placed into a vented oven and heated to approximately 500° F. to 700° F. and preferably about 600° F. for about 30 to 60 and preferably 45 minutes to drive off the gasses and organic components of the solvents and resins of the mixture. Then the tubes are heated in an unvented oven to about 1100° F. to 1400° F., and preferably, 1300° F. for a period of about 3 to 5 hours and preferably about 4 hours. Preferably the tubes are then allowed to cool naturally in the unvented oven to about 300° F. and are then force cooled to about room temperature. This fully cures the coating to deposit a dry film of platinum particles firmly adhered to the tubes.

After the tubes 82 have cooled to a temperature suitable for handling, the filament 10 is inserted in the tube and the end cap assemblies 84 are mounted on the ends of each tube 82. The assembled heating elements 10 are releaseably secured to the frame 50 by the channel shaped clips 62. The heating elements 10 are mounted in the clips 62 such that the portion of the tube 82 with the platinum coating 86 is located adjacent to the reflector plate 52 so that the coating 86 is on the back or distal portion of the tube 82 relative to the object to be heated. This positions the uncoated portion of the tube 82, which is the proximal portion of the tube relative to the object to be heated, so that it is generally facing or directed towards the object to be heated.

In use, when electrical current is passed through the filament 80 within the tube 82, infrared rays radiate in all directions from the filament 80. The infrared rays which are emitted in the direction of the uncoated portion of the tube 82, pass through the tube towards the interior of the oven 14 which contains the object 24 to be heated. The platinum coating 86 on the exterior of the distal portion of the tube 82 reflects infrared rays which would otherwise be emitted through the back of the tube and redirects those rays so that they are emitted through the uncoated portion of the tube and generally towards the object to be heated. This increases the amount of infrared radiation which is directed towards the object to be heated and thereby enhances the efficiency of heating the object. Similarly, the reflector plates 52 located adjacent the interior of the oven walls 16, 18, 20 and behind the heating elements 10 relative to the object to be heated, serve to continuously reflect infrared rays which are directed towards the exterior of the oven, towards the interior of the oven to enhance and promote heating of the object. Thus, both the reflective platinum coating 86 applied to the exterior of the distal portion of the heating elements 10 and the reflector plates 52 serve to increase the efficiency of the oven by reflecting and directing the infrared radiation within the oven towards the object to be heated.

I claim:

1. A method for making a reflective infrared heating element comprising the steps of:

a) providing a tube of a material transparent to infrared radiation and capable of being heated to a temperature of at least 1400° F. without degradation;

b) providing a liquid mixture containing freely divided platinum in an organic vehicle which will evaporate at a temperature of at least 500° F.;

c) applying said liquid mixture to a portion of the circumference of said tube; and d) heating the liquid mixture on the tube to a temperature in the range of about 500° F. to 700° F. for a period of about 30 to 60 minutes to at least partially evaporate and drive off the vehicle and thereafter to a temperature in the range of about 1100° F. to 1400° F. for a period of about three to six hours to adhere a dry film of a reflective coating of platinum onto said tube.

2. The method of claim 1 wherein said liquid mixture comprises liquid bright platinum.

3. The method of claim 2 wherein said liquid mixture comprises platinum, resin, and solvent, and by weight the platinum is about 1% to 12% of the resin.

4. The method of claim 1 wherein said liquid mixture is applied by spraying the liquid mixture onto the tube.

5. The method of claim 1 wherein said liquid coating is applied to substantially the entire axial length of the tube.

6. The method of claim 5 wherein said liquid coating is applied to not more than about 60% of the circumference of the tube.

7. The method of claim 1 wherein said liquid coating is applied to not more than about 60% of the circumference of the tube.

8. The method of claim 1 wherein said liquid coating comprises a mixture of a resin, a solvent and finely divided platinum dispersed in the mixture.

9. The method of claim 1 wherein said liquid mixture comprises platinum and gilsonite.

10. The method of claim 1 wherein said liquid mixture comprises platinum, terpineol, naphtha and gilsonite.

11. The method of claim 1 wherein said liquid mixture has a viscosity of about 52 to 57 seconds in a Zahn number two cup and is applied by spraying the liquid mixture onto the tube.

12. The method of claim 1 which also comprises heating the liquid mixture on the tube to about 1100° F. to 1400° F. for a period of three to six hours in an unvented oven, and cooling the coated tubes in the oven to a temperature not greater than about 300° F.

13. An infrared heating element comprising a hollow elongate tube of a material transparent to infrared radiation, an electric filament disposed within said tube, a pair of end cap assemblies on opposed ends of said tube and electrically connected to said filament to conduct electrical current thereto from an electrical source, and a reflective coating containing platinum on a surface of said tube and extending circumferentially over not more than about 60% of the surface of the tube and made by the method of a) providing a tube of a material transparent to infrared radiation and capable of being heated to a temperature of at least 1400° F. without degradation;

b) providing a liquid mixture containing freely divided platinum in an organic vehicle which will evaporate at a temperature of at least 500° F.;

c) applying said liquid mixture to a portion of the circumference of said tube; and d) heating the liquid mixture on the tube to a temperature in the range of about 500° F. to 700° F. for a period of about 30 to 60 minutes to at least partially evaporate and drive off the vehicle and thereafter to a temperature in the range of about 1100° F. to 1400° F. for a period of about three to six hours to adhere a dry film of a reflective coating of platinum onto said tube.

* * * * *